US008022318B2

(12) United States Patent
Fargo et al.

(10) Patent No.: US 8,022,318 B2
(45) Date of Patent: Sep. 20, 2011

(54) ARRANGEMENT FOR REMOVABLE CONTROL ELEMENTS

(75) Inventors: James F. Fargo, Winnetka, IL (US); Joseph P. Moninski, Arlington Heights, IL (US); Joel A. Ramos, Chicago, IL (US)

(73) Assignee: S&C Electric Company, Chicago, IL (US)

( * ) Notice: Subject to any disclaimer, the term of this patent is extended or adjusted under 35 U.S.C. 154(b) by 1162 days.

(21) Appl. No.: 11/599,201

(22) Filed: Nov. 13, 2006

(65) Prior Publication Data

US 2007/0129848 A1 Jun. 7, 2007

Related U.S. Application Data

(60) Provisional application No. 60/741,035, filed on Nov. 29, 2005.

(51) Int. Cl.
*H01H 27/06* (2006.01)

(52) U.S. Cl. ..... 200/43.08; 200/43.04

(58) Field of Classification Search ..... 200/43.04, 200/323, 337, 50.21
See application file for complete search history.

(56) References Cited

U.S. PATENT DOCUMENTS

| | | | | |
|---|---|---|---|---|
| 5,856,642 | A * | 1/1999 | Sanders | 200/17 R |
| 6,674,027 | B2 * | 1/2004 | Kowalyshen et al. | 200/43.04 |
| 7,019,230 | B1 * | 3/2006 | Vaill et al. | 200/50.24 |
| 2007/0205086 | A1 * | 9/2007 | Meyer et al. | 200/17 R |

* cited by examiner

*Primary Examiner* — Renee Luebke
*Assistant Examiner* — Lheiren Mae Caroc

(57) ABSTRACT

An arrangement is provided for the overall handling of removable controls for an electrical device including the installation and removal of controls from a base or other housing portion of the overall device, e.g. an overhead switch utilized in electrical power distribution/transmission. The arrangement includes facilities for selectively securing or releasing the controls with respect to cooperating housing portions of the device. An operating member is provided with provisions for cooperating with the controls for securing and releasing the control with respect to the operating member. In a preferred arrangement, the controls have separate control functions.

3 Claims, 3 Drawing Sheets

ARRANGEMENT FOR REMOVABLE CONTROL ELEMENTS

This application claims the benefit of U.S. Provisional Application No. 60/741,035 filed Nov. 29, 2005.

BACKGROUND OF THE INVENTION

1. Field of the Invention

The present invention relates generally to the field of electrical power systems and, more particularly, to an arrangement for the overall handling of removable controls for an electrical device including the installation and removal of controls from a base or other housing portion of the overall device.

2. Description of the Related Art

Various arrangements are known for handling and/or operating components and devices. For example, the operating arrangements shown in U.S. Pat. No. 6,674,027 is directed to the attachment and retention of a charging tool in an operating mechanism.

While the prior art arrangements may be generally useful, they do not provide a handling arrangement for removable control elements for the secure removal and installation of the removable control elements.

BRIEF DESCRIPTION OF THE DRAWING

The invention, both as to its organization and method of operation, together with further objects and advantages thereof, will best be understood by reference to the specification taken in conjunction with the accompanying drawing in which.

DETAILED DESCRIPTION

Figure 1:
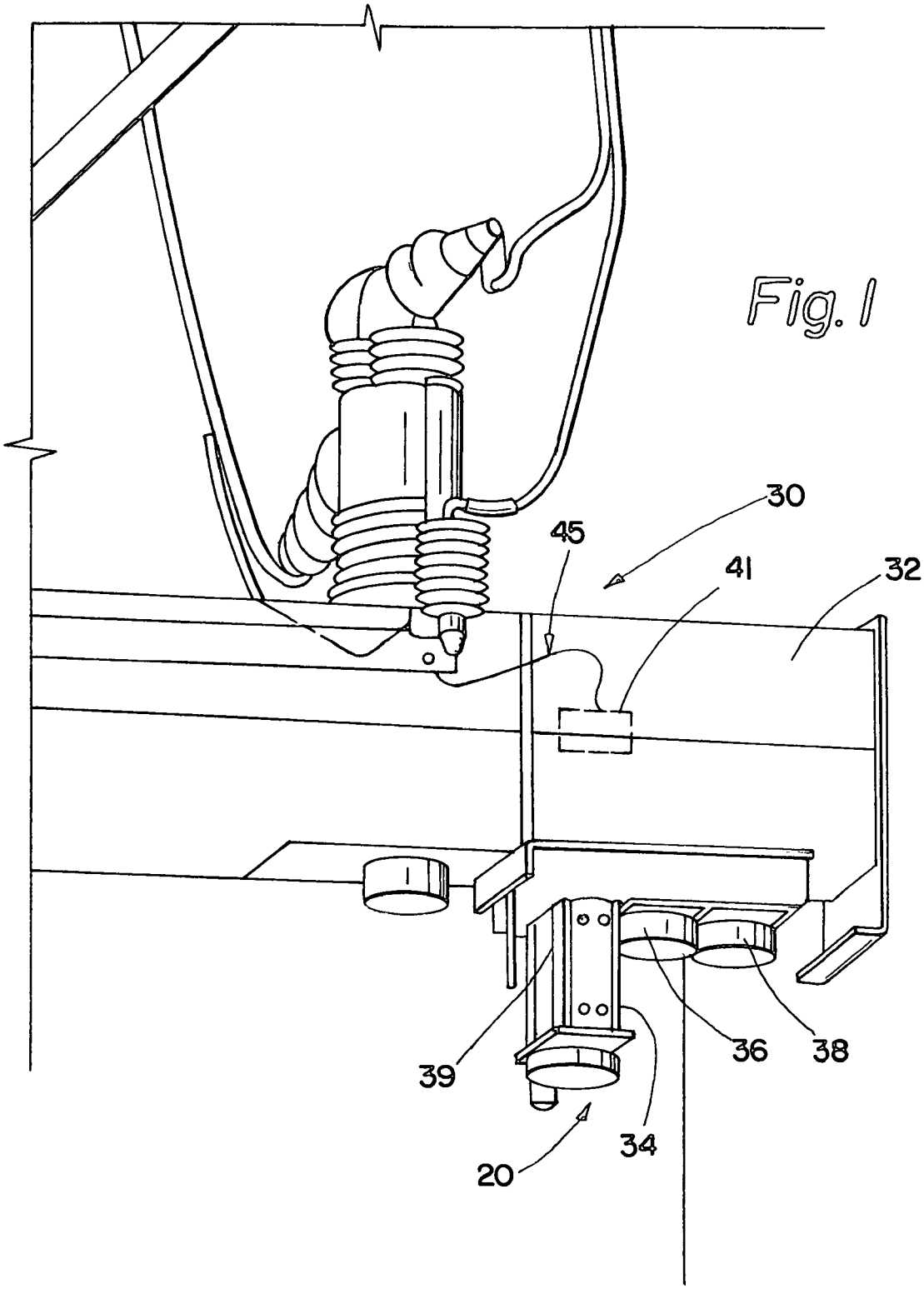
FIG. 1 is a perspective view of an electrical device utilizing the handling arrangement and removable control elements of the present invention.

Referring now to FIG. 1, the arrangement 20 of the present invention for handling removable controls is provided for use with an electrical device 30, e.g. an illustrative switch or circuit interrupter as shown that includes an automatic testing and closing feature in a specific implementation. In an illustrative example, the device 30 includes a base 32 that houses operating components such as actuators and communication and control facilities of the device 30 including one or more removable controls, e.g. 34, 36 and 38, which may be characterized as units or modules. While the terms "unit" or "module" may be used for reference purposes, the physical configuration of the removable controls 34, 36, 38 are most conveniently in the general shape of removable drawers, although other shapes are also suitable to practice the invention. Further, while the removable controls 34, 36, 38 are illustrated as being spaced in a line along the expanse or length of the base 32, it should be realized that the removable controls are arranged in various other configurations in other specific embodiments of the present invention, e.g. across the width of the base 32 or other, irregular patterns.

In accordance with important aspects of the present invention, the separately removable controls 34, 36, 38 provide for a segregation of the overall functions of the device 30 and therefore replacement of selected functions according to this segregation, i.e. without requiring the removal of the total functions of the device 30 which would render the device 30 totally inoperative. In one embodiment, which should be interpreted in an illustrative sense and not in any limiting sense, the removable controls include a system control 34, a communication control or radio 36, and an energy storage or battery 38. Thus, in that embodiment, an operator could remove and change out the radio 36 or the battery 38 while permitting the device 30 to continue to function during this process. Further, this permits troubleshooting by function, i.e. change out of one function at a time. In one embodiment, the system control 34 is selectively connected to a connector 41 and electrical connections 45 connect the system control 34 to the device 30.

While the removability of the removable controls 34, 36, 38 is extremely useful to provide servicing, replacement, updating etc., the process of removal and insertion of the controls must be secure and reliable, especially where the device 30 and controls 34, 36, 38 are remotely located such as atop a utility pole or the like. For example, if a handling tool or stick is required to access or reach the controls 34, 36, 38, the process of attachment to and removal of the controls 34, 36, 38 must be positive and secure so as not to drop the controls and to ensure accurate insertion of the controls. In addition to the handling of the controls being positive and secure, for remote handling, the base 32 and the controls 34, 36, 38 also include arrangements for guiding the controls into the base 32 and secure attachment thereto upon manipulation of the handling tool or stick. In this regard, it is important that an operator receive both visual and tactile feedback to indicate secure attachment of the controls with respect to the base 30 upon installing as well as secure attachment of the controls to the handling tool during the removal process. Further, the controls are electrically connected to connector facilities in the base 30 upon insertion for appropriate connection to other controls and portions of the device.

Figure 2:
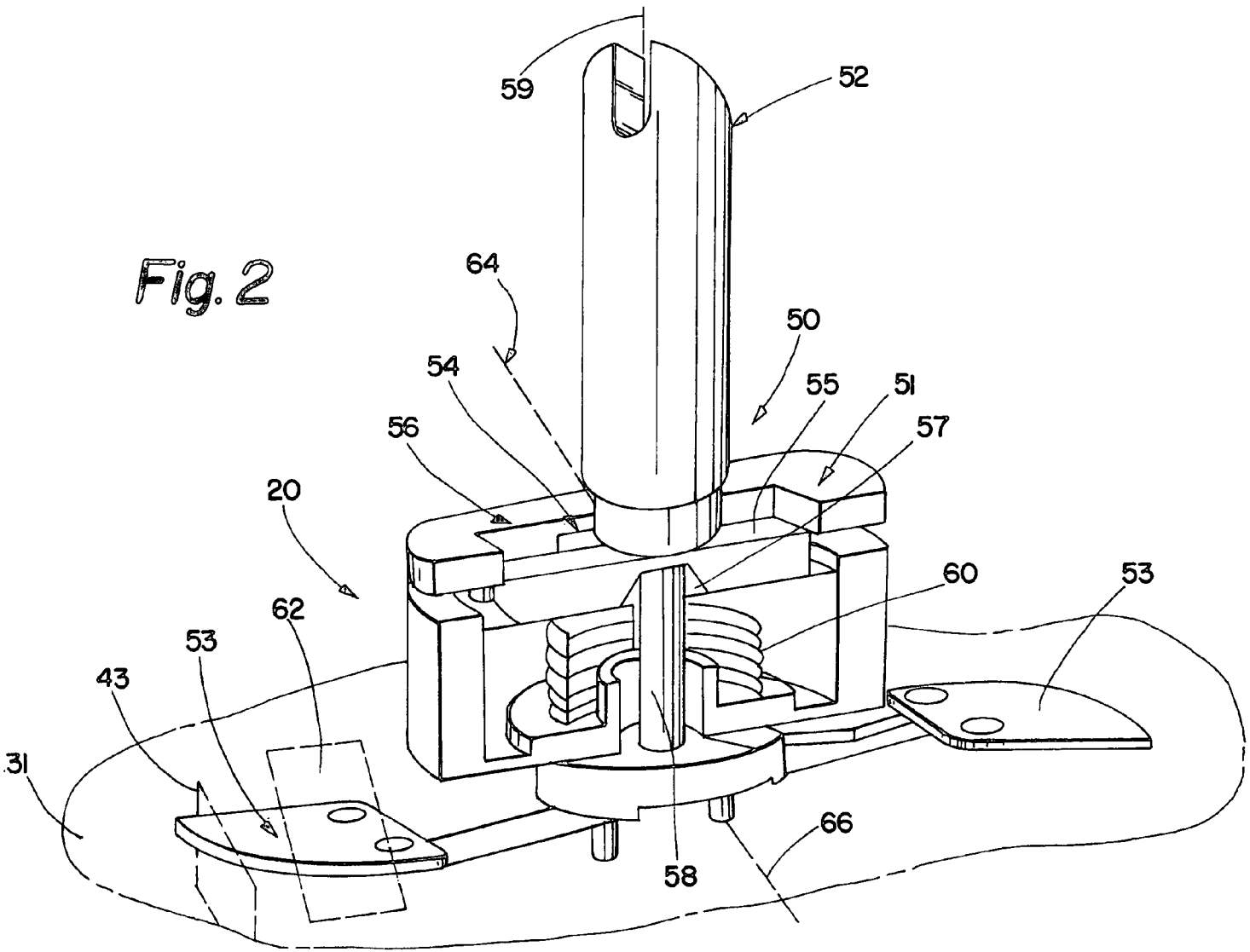
FIG. 2 is a detailed view of portions of the handling arrangement and removable control elements of FIG. 1.

Considering now the details of one embodiment of the arrangement 20 of the present invention and with additional reference now to FIG. 2, the arrangement 20 includes an operating arrangement 50. The operating arrangement 50 includes a first operating member 52 that cooperates with facilities carried by the controls 34, 36, 38. In an illustrative embodiment, the first operating member 52 is provided as a keyed end adapter that is affixed to a universal hotstick of the type commonly utilized by electrical utilities. The controls 34, 36, 38 include a movable drive plunger 58 that is engaged by the first operating member 52. The first operating member 52 at its leading edge includes elongated wings or the like illustrated at 55 that are shaped to cooperate with a latch slot 56 provided within a cover plate 51 of the controls 34, 36, 38, i.e. the shape of the wings 55 and the latch slot 56 are arranged so that the first operating member 52 can enter the cover plate 51 thus permitting operation of the operating arrangement 50. The leading end of the first operating member 52 also includes a receptacle or socket 57 into which the drive plunger 58 is received.

During operation, to either remove the controls 34, 36, 38 from their inserted, operative position or to simply attach the first operating member 52 to controls 34, 36, 38, the first operating member 52 is inserted through the latch slot 56 and an axial force along 59 is applied to depress the drive plunger 58 against the resilient force of a compression spring 60. After the first operating member 52 and the drive plunger 58 are moved to approximately the position shown in FIG. 2 below the inner surface of the cover plate 51, the first operating member 52 is rotatable to a position approximately 90 degrees from that shown in FIG. 2 whereat the spring 60 moves the wings 55 and the remainder of the first operating member 52 into a detent slot 54 formed in the cover plate 51 whereat the first operating member 52 moves with a "snap-action" along the axis 59 such that the operator receives tactile feedback that the first operating member 52 is in an operable position locked to the control 34, 36 or 38 with the cooperation of the wings 55 within the detent slot 54 now preventing relative rotation of the first operating member 52 with respect to the control 34, 36 or 38.

The operating arrangement 50 also includes latch tangs 53 extending from the drive plunger 58 and extending therefrom and rotatable therewith. The controls 34, 36, 38 include windows 61 within a face plate 31 such that the windows 61 are aligned with and allow visibility of the latch tangs 53 with the operating member and drive plunger in the unlocked position as shown in FIG. 2 while visibility of the latch tangs 53 are prevented (i.e. not visible through or aligned with the windows 61) when the operating member 52 is in the locked operating position with the wings 55 aligned along the axis 64 and the latch tangs 53 aligned along the axis 66. Thus, the operator receives visual feedback that the operating member 52 is not locked to the control 34, 36 or 38 if the latch tangs 53 are visible in the windows 62.

If the control 34, 36 or 38 is being inserted into the base 32, the control is moved via the attached operating member 42 into the base 32 via guiding structure 39 cooperating with the base 32. When the control, e.g. 34, is moved into operating position so as to engage and make suitable secure contact with the connector 41 carried by the base 32, additional force is applied along the axial direction of axis 59 to permit rotation and removal of the operating member 52 with respect to the control 34 and also ensuring that the control 34 is fully inserted into the operative position. Specifically, the additional axial force is required to move the wings 55 free of the detent slot 54 below the inner surface of the cover plate 51 which action provides tactile feedback to the operator that the control 34 is locked into its inserted, operative position. Additionally, with the drive plunger 58 and the latch tangs 53 again now in the position of FIG. 2, the latch tangs 53 are visible in the windows 62. The base 32 includes latch engagement structure at 43 that cooperates to receive the latch tangs 53 and lock the control 34 in place within and with respect to the base 32. With the wings 55 aligned with the latch slot 56, the operating member 52 is then disengaged from the drive plunger 58 and removable along the axial axis 59.

Figure 5:
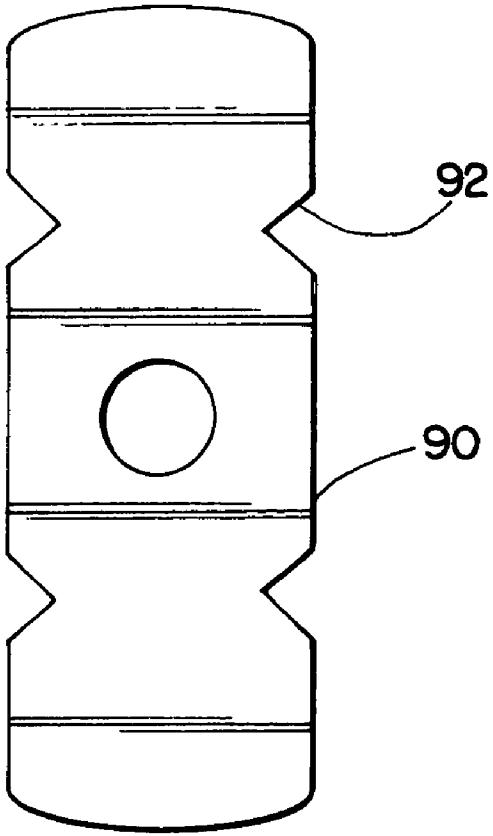
FIGS. 3-5 are examples of illustrative keying components useful in the practice of the present invention of FIGS. 1-2.
Figure 4:
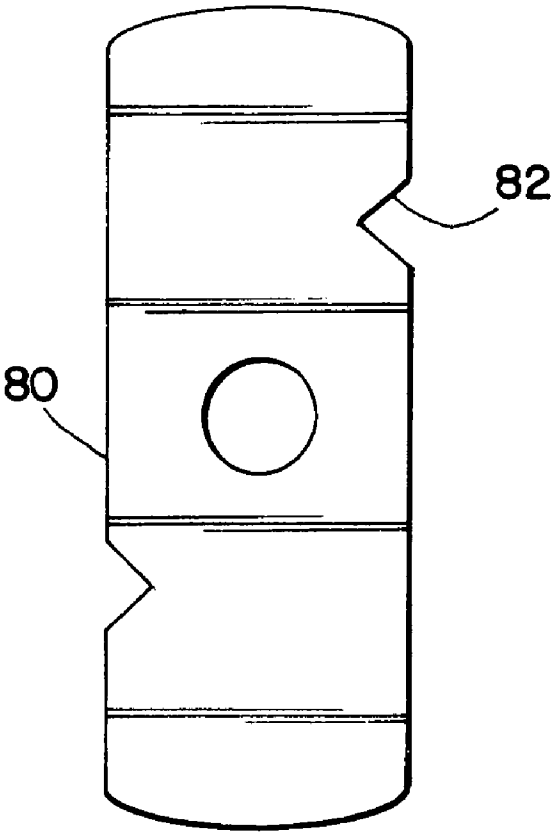
Figure 3:
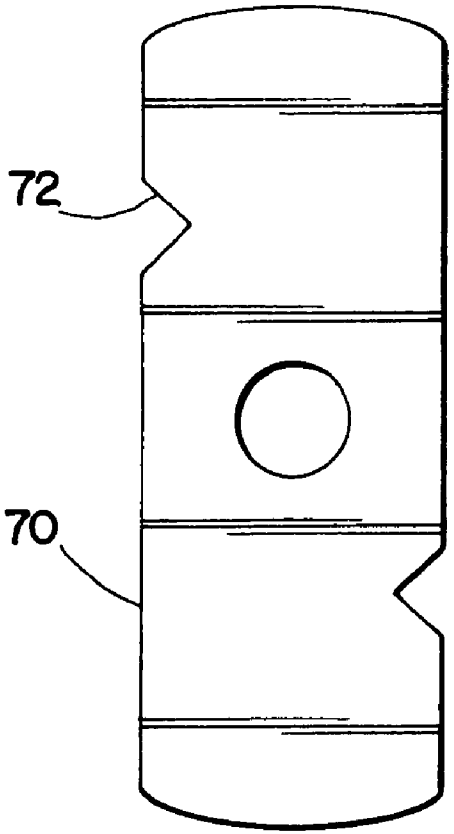

In accordance with additional important aspects of the present invention and with additional reference now to FIGS. 3-5, the cross section of the end of the operating member 52, i.e. the wings 55, are provided with different shapes and patterns of notches that match as inverse images the shape of the openings of the latch slots 56. For example, in an illustrative embodiment, the controls 34, 36 include the respective shapes 70, 80 of FIGS. 3-4. In this way, the operating member 52 is configured with one of the shapes 70 or 80 in accordance with the function of the control 34, 36. For example, in one illustrative embodiment, the different patterns are accomplished via different patterns and arrangements of notches, notch 72 for pattern 70, notch 82 for pattern 80 and notch 92 for pattern 90. The pattern 90 provided via notches 92 functions as a master operating member for an operator with authorization to work on controls of all types, i.e. arranged to operate with controls 34 or 35 and interfitting with the latch slots 56 for both types. Conversely, if an operator is authorized only to change the radio control 36 or the battery control 38, that category of operator is prevented from changing the other controls, e.g. system control 34.

While the present disclosure is susceptible to various modifications and alternative forms, certain embodiments are shown by way of example in the drawings and the herein described embodiments. It will be understood, however, that this disclosure is not intended to limit the invention to the particular forms described, but to the contrary, the invention is intended to cover all modifications, alternatives, and equivalents defined by the appended claims.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning. Unless a claim element is defined by reciting the word "means" and a function without the recital of any structure, it is not intended that the scope of any claim element be interpreted based on the application of 35 U.S.C. §112, sixth paragraph.

The invention claimed is:

1. An arrangement for the handling of one or more removable controls for a device including the installation and removal of controls from a housing portion of the device; the arrangement comprising:

each removable control being disposed within the housing and having an associated drive plunger, the housing having a cover plate formed with an access aperture having a latch slot and a detent slot for each removable control, and a spring biasing the drive plunger; and an operating member adapted to engage a drive plunger of a removable control to be installed or removed, the operating member engaging the drive plunger via the access aperture with a key portion of the operating member being received within the latch slot and axially displacing the drive plunger against bias force of the spring, the operating member being rotatable with the drive plunger to engage the key portion with the detent slot under bias force of the spring thereby locking the operating member with the removable control.

2. The arrangement of claim 1, the latch slot formed as a pattern corresponding to a respective removable control and a key portion of an operating member associated with the respective removable control corresponding with the pattern.

3. The arrangement of claim 1, tangs formed on the operating member and a viewing aperture formed in the cover plate, the tangs being visible within the viewing aperture with the key portion engaged within the detent slot.

* * * * *